United States Patent [19]

Kinley

[11] Patent Number: 4,741,628

[45] Date of Patent: May 3, 1988

[54] CABINET AND DRAWER GUIDE ASSEMBLY

[76] Inventor: Billy R. Kinley, P.O. Drawer 870, High Point, N.C. 27261

[21] Appl. No.: 879,929

[22] Filed: Jun. 30, 1986

[51] Int. Cl.[4] ..... A47B 88/00; F16C 23/00

[52] U.S. Cl. ..... 384/19; 384/22; 384/38; 384/40; 312/341 R; 312/350

[58] Field of Search ..... 384/18, 19, 20, 22, 384/23, 38, 40, 49, 57, 50; 312/330 R, 343, 332, 341 R, 350

[56] References Cited

U.S. PATENT DOCUMENTS

| | | | |
|---|---|---|---|
| 3,658,399 | 4/1972 | Vogt | 312/343 |
| 3,675,883 | 7/1972 | Holmes et al. | 312/343 X |
| 3,750,993 | 8/1973 | Read | 312/343 X |
| 3,836,223 | 9/1974 | Signore | 312/350 |
| 4,176,890 | 12/1979 | Gorton | 312/343 |
| 4,244,546 | 1/1981 | Merter et al. | 312/343 X |
| 4,278,309 | 7/1981 | Dreiling | 384/22 X |

*Primary Examiner*—David Werner

[57] ABSTRACT

The present invention provides a cabinet having a drawer guide assembly with a pair of longitudinal rearwardly extending parallel members which are pivotally attached to a floating transverse member. The assembly allows for a smooth, durable drawer movement even in the event that the cabinet is installed with the sides, front, top or rear misaligned.

8 Claims, 1 Drawing Sheet

FIG. 4
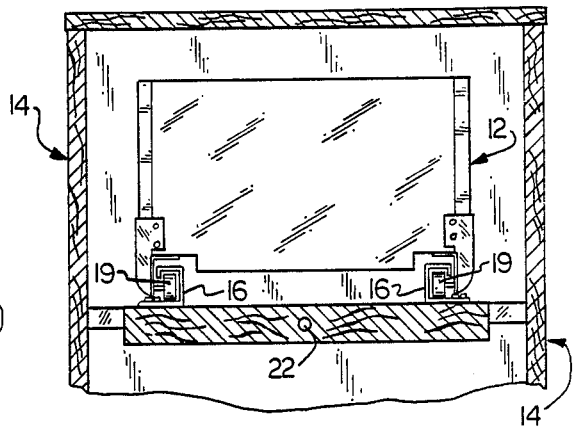
FIG. 3
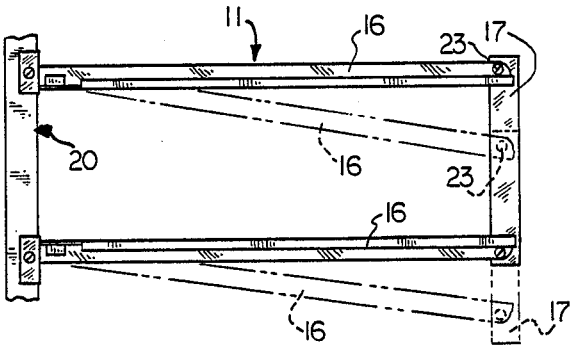
FIG. 2
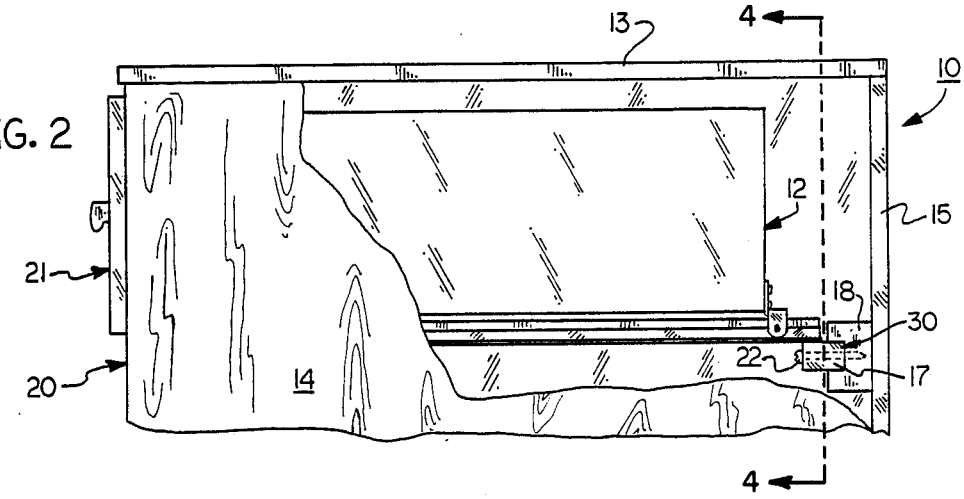
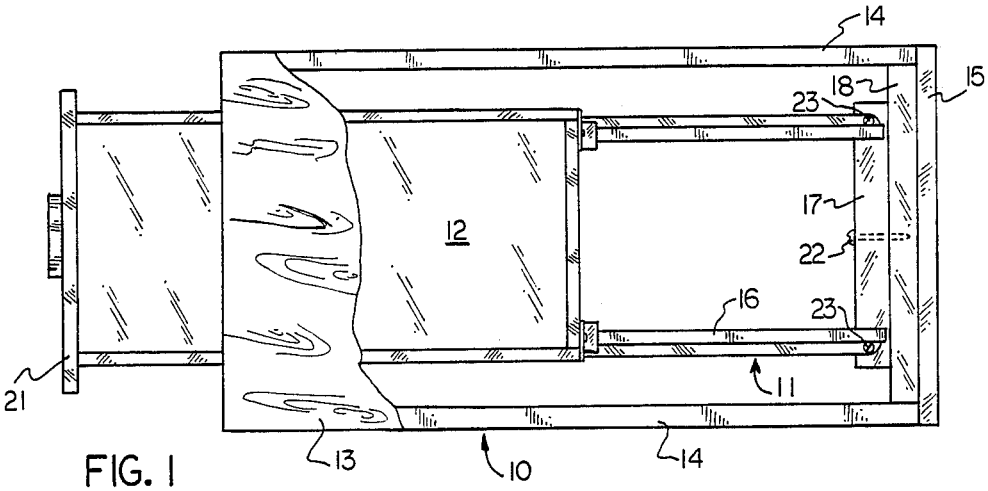
FIG. 1

CABINET AND DRAWER GUIDE ASSEMBLY

BACKGROUND OF THE INVENTION

1. Field of the Invention

The present invention relates to cabinets and drawer guide assemblys for movable drawers which are shop manufactured and subsequently installed in homes, offices or the like.

2. Description of the Prior Art and Objectives of the Invention

In the past cabinets for kitchens, offices and otherwise having movable drawers were built and installed by carpenters on site. Later, as production techniques improved, cabinets were partially built in shops and plants for transportation to the job site where they were completed, adjusted, installed and finished. Such manufactured cabinets have proved very successful and economically suitable for the construction trade in recent years. However, manufactured cabinets are often criticized by master carpenters since during the installation process unskilled carpenters may improperly attach the counter top or may disturb the integrity and alignment of the cabinet walls in positioning and attaching them to permanent building structures. Thus a cabinet which is perfectly "square" when it leaves the factory may be installed slightly "out of kilter". Such misaligned or poorly installed cabinets with one or two drawer guides per drawer oftentimes tend to prevent the drawer from opening and closing smoothly or the installer has to spend several hours realigning the drawer guides so the drawer will easily work. Many conventional drawer guides attach to the back and front of the cabinets and therefore if the cabinet is out of square the drawer guide is misaligned in such a manner that the drawer will not close properly giving drawer front proper alignment with the front of the cabinet.

Attempts have been made to prevent misalignment of drawer guides such as by having single center drawer guides which are of the horizontally "floating" (at the rear) type. However, until now no satisfactory solution has been found for a drawer guide assembly having dual tracks or guides which are preferred in quality manufactured cabinets that require the smoothest drawer movement.

With the disadvantages and problems associated with conventional drawer guides the present invention was conceived and one of its objectives is to provide a drawer guide assembly having dual guides or longitudinal members which are pivotally attached at the rear of the cabinet to a single transverse member.

It is still another ojbective of the present invention to provide a horizontally "floating" drawer guide assembly which is self-aligning whereby the longitudinal members maintain a parallel relationship and which can be quickly and properly installed by relatively unskilled carpenters.

It is yet another object of the present invention to provide a drawer guide assembly which includes a race for maintaining the transverse member in a suitable vertical position.

It is still another objective of the present invention to provide a cabinet and drawer guide assembly which is relatively inexpensive to manufacture, is easy to install and which will provide long term satisfaction and ease of use by the consumer.

Other advantages and objectives of the invention will be realized for those skilled in the art as a fuller explanation of the invention is presented below.

SUMMARY OF THE INVENTION

The aforesaid and other objectives of the invention are realized by providing a cabinet having a movable drawer which is engagable with a drawer guide assembly having a pair of parallel longitudinal guides or members for directing the drawer along its path. The cabinet includes a front, side and rear wall to which is attached a race for maintaining a pivotally connected transverse member to the parallel guides. The parallel guides are free to move laterally while maintaining their parallel relationship as the transverse member moves within the race.

BRIEF DESCRIPTION OF THE DRAWINGS

FIG. 1 is a top view of a cabinet having a drawer guide assembly of the present invention;

FIG. 2 is a side view of the cabinet as shown in FIG. 1 with the drawer closed;

FIG. 3 demonstrates a top view of the drawer guide assembly of the invention; and FIG. 4 shows a rear cross-sectional view of the drawer guide assembly of the invention.

DESCRIPTION OF THE PREFERRED EMBODIMENT

The preferred form of the invention as seen in FIG. 1 demonstrates a cabinet having a movable drawer which can be opened by pulling the drawer out away from the front of the cabinet. An undermount drawer guide assembly which is engagable with the drawer includes a pair of rearwardly extending longitudinal channel members which are firmly affixed by screws or the like to the front of the cabinet and which are pivotally mounted to a transverse member which fits within a race on the rear cabinet wall. The race allows the transverse member to slide therein while the parallel alignment of the longitudinal members are maintained thus allowing ease of installation of the guide assembly and creating smooth and easy drawer operation even if the "square" of the cabinet is disturbed due to misalignment of the walls during cabinet installation on location.

DETAILED DESCRIPTION OF THE DRAWINGS

Turning now to the drawings, FIG. 1 demonstrates a top view of cabinet 10 having an undermount drawer guide assembly 11 mounted therein which is engagable with drawer 12. As would be understood the drawer guide assembly could also be of the side mount type. Cabinet 10 includes top 13, side walls 14 and rear wall or back 15. Guide assembly 11 includes left and right channel-shaped longitudinal members 16 and transverse member 17 having a rectangular shaped cross section to which longitudinal members 16 are pivotally attached by wood screws 23 to the top thereof. Transverse member 17 is slidably positioned in race 18 which has a rectangular shaped groove 30 whereby lateral movement of longitudinal members 16 are in unison to thus maintain their parallel relationship.

As seen in FIG. 4 drawer 12 includes rollers 19 which fit within for cooperative engagement with longitudinal channel-shaped members 16 to provide a relative frictionless drawer movement. In the event cabinet sides 14 are out of square (not parallel), drawer guides 16 which may be formed from a rigid or stiff metal self-align since transverse member 17 "floats" within race 18 as shown in FIG. 2 providing for a smooth drawer movement even in the event that the cabinet is misaligned during installation. Thus, drawer front 21 will properly close against cabinet front 20 and be flush therewith even if side walls 14 are slightly non-parallel.

Transverse member 17 may be provided with a securing member 22 such a wood screw for use by the installers to prevent continued "floating" action of the transverse member 17 within race 18 after the initial cabinet installation is complete and proper drawer movement is achieved. Securing member 22 can be removed to readjust the drawer guide assembly 11.

FIG. 3 demonstates a top view of drawer guide assembly 11 in schematic fashion and illustrates the movement of transverse member 17 and the subsequent parallel alignment of longitudinal members 16.

Various changes and modifications can be made to the cabinet and drawer guide assembly as shown herein and the illustrations and examples are for illustrative purposes and are not intented to limit the scope of the appended claims.

I claim:

1. A drawer guide assembly for use in a cabinet or the like comprising: a pair of longitudinal members for cooperatively engaging a drawer, said longitudinal members affixed to the front of the cabinet and extending in parallel alignment therefrom, a transverse member, said longitudinal members pivotally attached to said transverse member, a guide member, said guide member contiguous with said transverse member, said transverse member adjustably movable laterally along said guide member whereby said longitudinal members remain parallel as said transverse member moves laterally to effect self alignment of the drawer guide assembly.

2. A drawer guide assembly as claimed in claim 1 wherein said guide member comprises a race.

3. A drawer guide assembly as claimed in claim 1 wherein said longitudinal members are channel-shaped.

4. A drawer guide assembly as claimed in claim 1 wherein said longitudinal members are attached to the top of said transverse member.

5. A cabinet with a movable drawer comprising: a top, a pair of sides, a front, a back, said top, sides, front and back being joined together and having the drawer therein, a drawer guide assembly positioned within the cabinet engagable with the drawer, said drawer guide assembly including:

(a) a pair of longitudinal members, and (b) a transverse member, said pair of longitudinal members affixed to said front of the cabinet and extending rearwardly, said longitudinal members pivotally attached to said transverse member, a race, said race attached to said back of cabinet, said transverse member slidably positioned to said race whereby said longitudinal members upon lateral movement remain parallel as said transverse member moves within said race.

6. A cabinet as claimed in claim 5 wherein said longitudinal members are channel-shaped.

7. A cabinet as claimed in claim 5 wherein said transverse member has a rectangular cross section.

8. A cabinet with a movable drawer comprising: a top, a pair of sides, a front, a back, said top, sides, front and back being joined together and having the drawer therein, a drawer guide assembly positioned within the cabinet engageable with the drawer, said drawer guide assembly including:

(a) a pair of longitudinal members, and (b) a transverse member, said pair of longitudinal members affixed to said front of the cabinet and extending rearwardly, said longitudinal members pivotally attached to said transverse member, a guide member, said guide member contiguous with said transverse member, said transverse member adjustably slidably positionable along said guide member whereby said longitudinal members remain parallel as said transverse member slides laterally along the rear of the cabinet.

* * * * *